US007404923B2

(12) United States Patent
Bauden

(10) Patent No.: US 7,404,923 B2
(45) Date of Patent: Jul. 29, 2008

(54) DEVICE FOR COOLING AND/OR RINSING STEEL WIRES AND/OR TAPES

(75) Inventor: Jacques Bauden, Lillois (BE)

(73) Assignee: Le Four Industriel Belge, Brussels (BE)

( * ) Notice: Subject to any disclaimer, the term of this patent is extended or adjusted under 35 U.S.C. 154(b) by 636 days.

(21) Appl. No.: 10/516,593

(22) PCT Filed: Jun. 5, 2003

(86) PCT No.: PCT/BE03/00101

§ 371 (c)(1),
(2), (4) Date: Dec. 3, 2004

(87) PCT Pub. No.: WO03/104500

PCT Pub. Date: Dec. 18, 2003

(65) Prior Publication Data

US 2005/0173848 A1 Aug. 11, 2005

(30) Foreign Application Priority Data

Jun. 6, 2002 (BE) ..... 2002/0373

(51) Int. Cl.
*C21D 1/667* (2006.01)

(52) U.S. Cl. ..... 266/113

(58) Field of Classification Search ..... 266/113
See application file for complete search history.

(56) References Cited

U.S. PATENT DOCUMENTS

| | | | | |
|---|---|---|---|---|
| 3,734,109 | A | 5/1973 | Hebner | |
| 3,997,376 | A | 12/1976 | Hemsath et al. | |
| 4,270,317 | A | 6/1981 | Kurie | |
| 4,570,453 | A * | 2/1986 | Kamio et al. | 266/113 |

FOREIGN PATENT DOCUMENTS

| | | |
|---|---|---|
| EP | 0 216 434 A1 | 4/1987 |
| EP | 0 482 725 A | 4/1992 |
| EP | 0 524 689 B1 | 1/1993 |
| EP | 1 008 676 A | 6/2000 |
| FR | 832.391 | 1/1975 |

* cited by examiner

*Primary Examiner*—Scott Kastler
(74) *Attorney, Agent, or Firm*—Birch, Stewart, Kolasch & Birch, LLP

(57) ABSTRACT

Disclosed is a device for cooling and/or rinsing at least one steel wire and/or tape, with a member for conveying at least one steel wire and/or tape, a basin which contains a cooling and/or rinsing liquid and is provided with outlets from which a certain number of successive liquid curtains flow in a turbulent manner, the at least one steel wire and/or tape being conveyed through the liquid curtains, and an adjustor for adjusting the number of successive curtains to be penetrated by the at least one steel wire and/or tape according to the cooling and/or rinsing that is to be obtained.

6 Claims, 2 Drawing Sheets

DEVICE FOR COOLING AND/OR RINSING STEEL WIRES AND/OR TAPES

BACKGROUND OF THE INVENTION

1. Field of the Invention

The present invention relates to a device for cooling and/or rinsing at least one steel wire and/or ribbon.

2. Description of Background Art

Cooling baths for wires intended for quenching steel wires with a view to obtaining transformation thereof have been known for a long time. It is possible to cite for example the patenting of steel wires comprising an isothermal quenching, that is to say a rapid cooling of tyres brought at the austenitic temperature into a perlitic formation zone where the wires are maintained more or less isothermally in order to ensure the substantially complete decomposition of the austenite and a detensioning of the steel.

Methods are known making use of molten lead or salt baths in which the wires to be cooled are immersed. These methods, which are very effective, are to be proscribed at the present time for reasons of toxicity and hazard to the environment.

Methods are also known making use of aqueous baths. During immersion in such a water bath, with laminar non-turbulent flow, a film of vapour forms all around the wires to be cooled, which slows down the cooling (see for example EP-A-0 216 434).

In order to judiciously control the intensity and speed of cooling, as well as keeping the wires as isothermal as possible during their perlitic transformation, it has also been proposed to make the wires pass through several laminar-flow water baths, with on each occasion the formation of a film of vapour around the wires to be cooled, and, between various aqueous baths, in alternation a cooling by air, during which the vapour film disappears (see for example EP-B-0 524 689). Such a method has the drawback of being technically very difficult to apply and to calculate in order to correctly determine when the steel wires have reached the required temperature.

Devices for cooling steel wires are also known comprising nozzles from which high-pressure water jets can be applied to the wires to be treated (see BE-A-832391). This fairly complex device does not allow fine adjustment of the cooling temperature, requires the use of a high-pressure circulation pump and a circuit of pipes, reservoirs and nozzles which are susceptible to problems of blockage.

Aqueous baths are also known whose purpose is the rinsing of steel wires for example before and/or after an acid pickling bath.

It should be noted that all these liquid baths according to the prior art require a liquid pumping system which consumes a great deal of energy.

SUMMARY AND OBJECTS OF THE INVENTION

The aim of the present invention is to develop a simple and inexpensive device which makes it possible to surmount the aforementioned drawbacks.

This problem is resolved according to the invention by a device for cooling and/or rinsing at least one steel wire and/or ribbon, comprising means of driving in movement at least one steel wire or ribbon, this device also comprising a vessel containing a cooling and/or rinsing liquid and provided with outlets from which a certain number of successive curtains of liquid, through which the said at least one steel wire and/or ribbon passes, flow turbulently, and means of adjusting the number of successive curtains to be passed through by the said at least one wire and/or ribbon according to the cooling and/or rinsing to be obtained.

This device offers the advantage that the contact between the cooling liquid and the wire or ribbon is direct, without the possibility of the formation of a film of vapour around the wire or ribbon, a film where the heat exchange is appreciably less favourable. Given the speed of movement of the wire combined with the speed of flow of each curtain transversely to the direction of movement of the wire, the cooling liquid does not have the time to form a vapour film around the wire and the liquid/steel wire heat exchange remains excellent.

Simultaneously the method offers the advantage of being able to stop the cooling at any required temperature by a simple determination of the number of curtains necessary. This is particularly important in the case of the patenting of steel wires, where it is necessary to avoid an excessively rapid quenching which gives rise to the appearance of martensite in the steel, which is to be avoided in the majority of cases. To this end, a simple adjustment of the number of curtains to be passed through according to the speed of movement of the wire and the flow of the cooling liquid, as well as the diameter of the wire to be cooled, suffices. This adjustment is simple since it suffices to stop the excess curtains or to start up the curtains necessary for reaching the required temperature. This same adjustment is suitable for rinsing and the number of curtains to be brought into service is determined in the same way, very easily.

According to one embodiment of the device according to the invention, the vessel is arranged below the said at least one wire and/or ribbon in movement and the device also comprises spouting means above the above-mentioned liquid curtains in a rising turbulent flow. The cooling liquid is sprayed under pressure in the manner of a continuous geyser and therefore very turbulent. Advantageously, the rising turbulent-flow curtains have a top and, from the said top and at least one said of each rising turbulent-flow curtain, a fall of turbulent-flow liquid through which the said at least one steel wire and/or ribbon also passes. When a geyser of this type is produced, the wire can therefore be passed through three successive streams of turbulent-flow liquid, one rising and the other two falling, which makes the cooling or rinsing which ensues very effective.

It is of course also possible to provide a tank arranged above the moving wires and the fall or spraying of cooling liquid curtains from the top.

According to one improved embodiment of the invention, the spray means of the device comprise means of feeding pressurized gas bubbles in a bottom part of the tank and means for the forced guidance, towards the said outlets, of the bubbles which entrain the liquid upwards in the form of rising turbulent-flow liquid curtains. Use will preferably be made of a gas which is inert vis-à-vis steel, in particular air. The pressurized air bubbles entrain the cooling liquid and simultaneously make its flow turbulent, which promotes the required direct heat exchange. In addition, the upward spraying by air bubbles does not require a costly expenditure of energy and makes it possible to avoid any cooling liquid pumping system.

The cooling and/or rinsing liquid can be any suitable liquid, water, lead, liquid salt, a polymer, oil, and in particular water, since all the drawbacks encountered by the use of water in the prior art can be surmounted by the method according to the invention.

The device is therefore in the form of a device which is simple and easy to control and to adjust and makes it possible to consume solely non-polluting and inexpensive materials, that is to say compressed air and cooling water.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

In the various drawings, the identical or similar elements bear the same references.

DETAILED DESCRIPTION OF THE PREFERRED EMBODIMENTS

For the description of the various figures reference is made to a device for cooling by water. This description remains applicable to the rinsing of the wires with a rinsing liquid or to cooling by any other cooling liquid.

Figure 1:
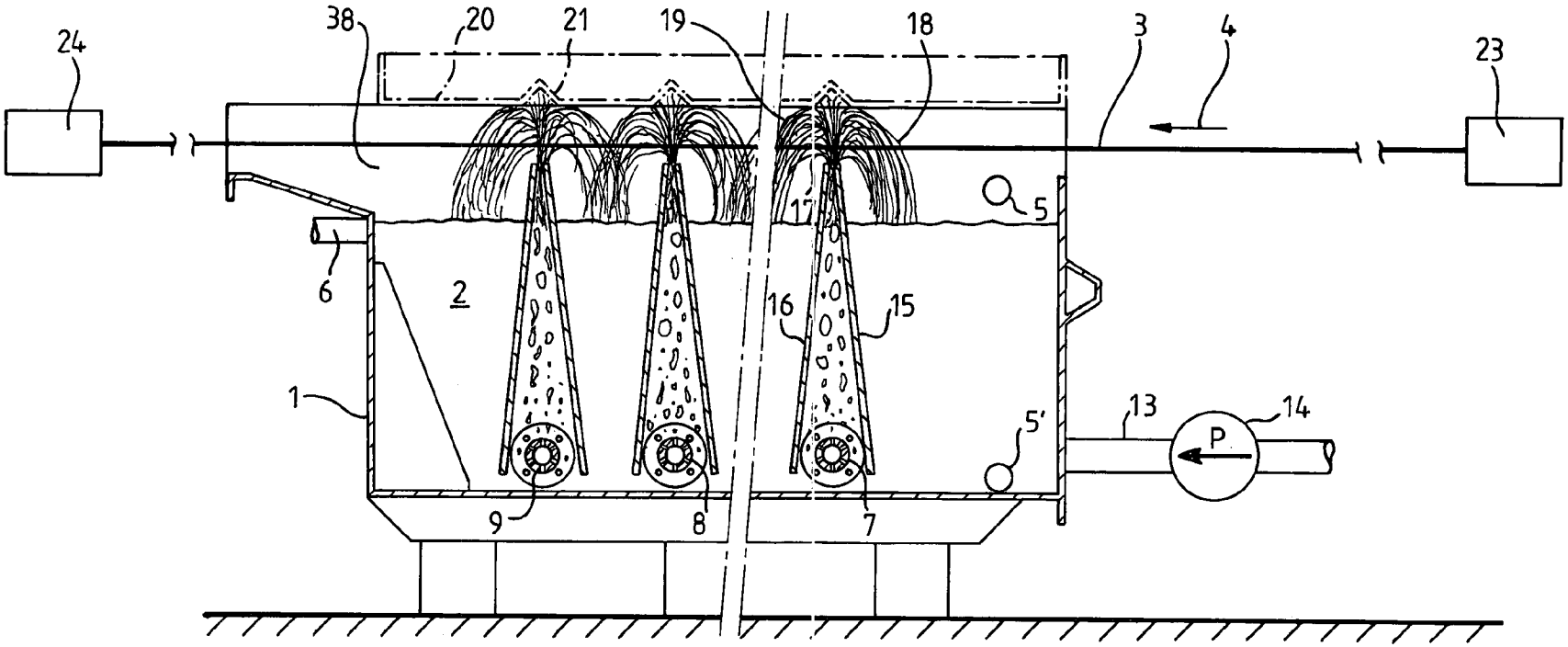
FIG. 1 depicts a view in longitudinal section of a device for cooling and/or rising steel wires and/or ribbons according to the invention; and, FIG. 2 depicts a plan view from above of FIG. 1.
Figure 2:
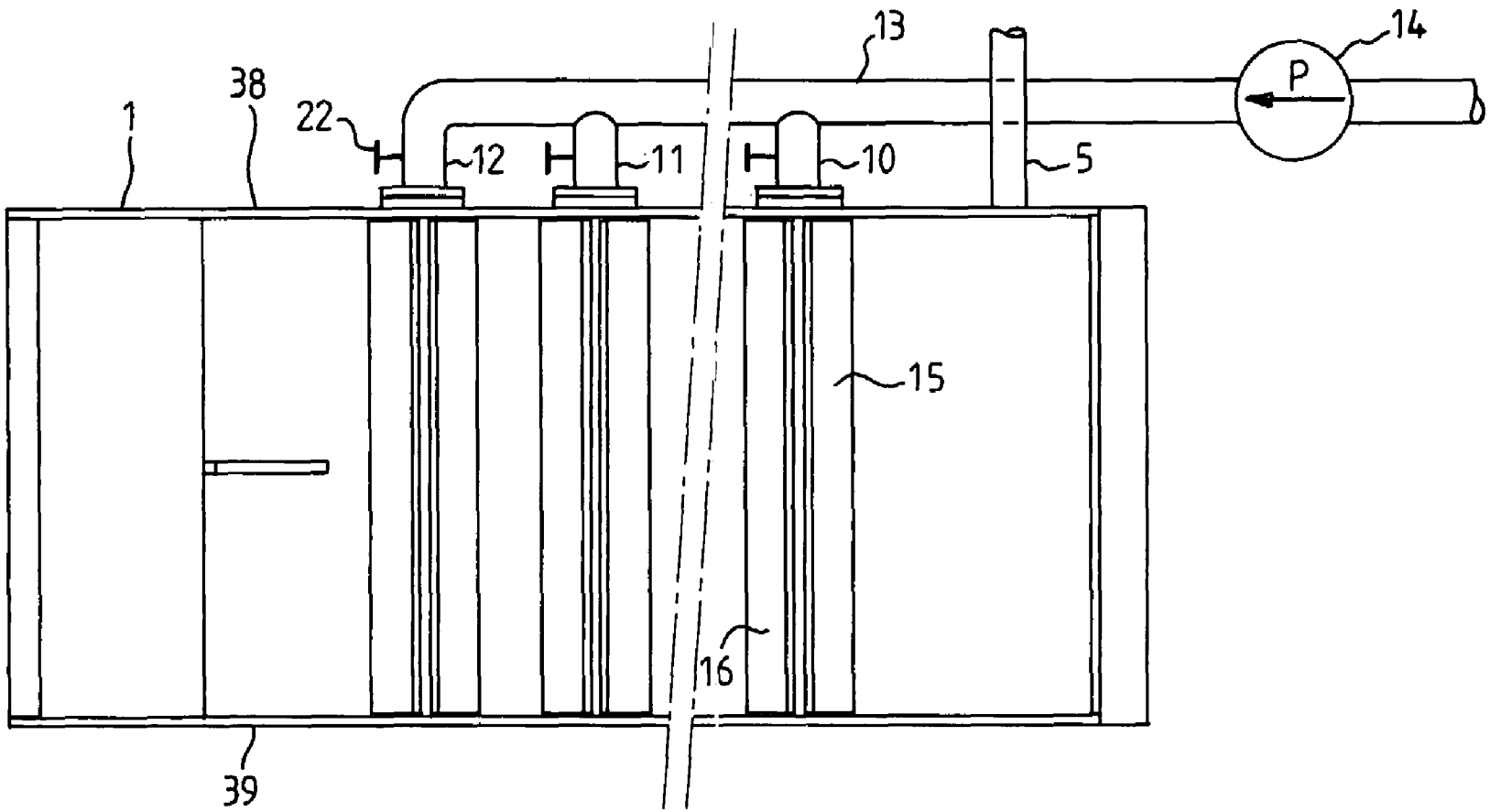

FIGS. 1 and 2 depict a tank 1 containing cooling water 2. Above this tank one or more steel wires 3 move in a direction of movement indicated by the arrow 4. Normal means for driving in movement are depicted schematically by the references 23 and 24. The water can be supplied by an inlet 5 and be discharged from above by an overflow 6. In the tank illustrated the water column height is approximately 750 mm of H2O (7350 Pa). The overflow 6 can be in communication with a bottom inlet 5', by means of a heat exchanger, not shown, so as to put the cooling water in circulation. The tank also comprises spouting for spraying rising water curtains. These spray means comprise air supply conduits 7 to 9 disposed at the bottom of the tank parallel to each other and transversely to the direction of movement of the wires and/or ribbons. Each of these conduits is connected, through corresponding openings in the tank and by means of couplings 10 to 12, to a distributing conduit 13 supplied with pressurized air by a fan 14. On each coupling 10 to 12 there is provided a closure valve 22 which makes it possible to adjust the pressurized air supply of the conduits 7 to 9 and put them in or out of service according to requirements.

In the example illustrated, the air supply conduits 7 to 9 are perforated and therefore supply, in the water in the tank, pressurized air bubbles. Above each conduit 7 to 9, two guide plates 15 and 16 are supported by the longitudinal walls 38 and 39 of the tank so as to pass right across the latter. At their top end, situated above the water level, guide plates are close together and thus form a thin outlet slot. At their bottom end, situated a little lower than their air supply conduit, the guide plates 15 and 16 have a separation appreciably greater than that presented at their top. The guide plates thus form a kind of roof between the two surfaces of which the bubbles are guided in a forced manner upwards. With an air pressure only slightly greater than the column of water, in the case illustrated a pressure of around 1000 mm of H2O (9806 Pa) for example, the air bubbles entrain the water in the tank during their rising and expel a turbulent water curtain 17 upwards. At the top of the water curtain, it can divide into two and form two turbulent falls of water 18 and 19 which the wire to be cooled must also pass through. The pairs of guide plates 15, 16 can be arranged in a sufficiently close manner in their succession so that the falls of water of the two adjacent curtains can cross. In this way, the wire passes continuously through the water, and nevertheless there is never the possibility of the formation of a film of water vapour around the wire.

It is possible to envisage, in certain cases, in particular in rinsing tanks, a cover 20 which closes the tank towards the top and which has deflectors 21 for orienting the direction of the falls of water 18 and 19.

During the cooling of the steel to be patented, it is very important for the temperature of the product corresponding to the required quality to be reached rapidly, and this before entering the transformation S curves of steel, which are well known, referred to as TTT curves (transformation, temperature, time) so that these can be passed through on an isotherm. When wires are patented with a cooling device as illustrated, which may comprise 20 curtains, only ten of which are brought into service, the wires are rapidly cooled by these first ten curtains to a temperature below the austenitic temperature and above the martensitic temperature, in particular between 500° and 680° C., for example around 580° C.

At this temperature, the wires are situated facing the nose of the S curves, that is to say at a temperature corresponding to the minimum incubation time, in order to pass through these curves, which makes it possible to avoid disturbances which could influence the structure of the steel.

In this way the rapid cooling obtained by the water curtains has been stopped at the required temperature, which is reached according to the number of curtains brought into service.

With the device described, if a martensitic quenching of steel is required, it suffices to increase the number of curtains to be passed through. During a patenting, the number of curtains to be brought into service will be decreased or increased, for example if the wires to be treated have a smaller or larger diameter or if their movement is slower or more rapid, for any reason.

It must be understood that the present invention is in no way limited to the embodiments described above and that many modifications can be made thereto without departing from the scope of the claims given below.

The invention claimed is:

1. A device for cooling and/or rinsing at least one steel wire and/or ribbon, comprising driving means for moving at least one steel wire or ribbon, a vessel arranged below the at least one moving steel wire and/or ribbon and containing a cooling and/or rinsing liquid, the vessel being provided with outlets from which a certain number of successive curtains of liquid flow turbulently, and spouting means for spouting the curtains of liquid from the outlets of the vessel in a rising curtain flow, the at least one moving steel wire and/or ribbon passing through successive curtains, the spouting means comprising:

supply means for supplying pressurized gas bubbles in a bottom part of the vessel and guidance means for forcibly guiding the bubbles towards the outlets, the bubbles entraining the liquid upwardly in a form of rising turbulent-flow curtains of liquid.

2. The device according to claim 1, wherein the spouting means for spouting the curtains of liquid are arranged so that there is, towards at least one side of each curtain after its rising, a fall of the liquid through which passes the at least one moving steel wire and/or ribbon.

3. The device according to claim 2, wherein the spouting means for spouting the liquid curtains are arranged with respect to each other so that the falls coming from at least two adjoining curtains intersect.

4. The device according to claim 1, further comprising:

deflecting means provided above the at least one moving steel wire and/or ribbon, the deflecting means adapted to divert the rising turbulent-flow curtains of liquid towards at least one side of each curtain, so as to form from there, at least one fall of turbulent-flow liquid through which the at least one steel wire and/or ribbon moves.

5. The device according to claim 1, wherein the force guidance means includes two plates supported on each side in the vessel, wherein top ends of the two plates are disposed above a level of the cooling and/or rinsing liquid, the tops ends of the two plates being separated by a first uniform narrow separation disposed perpendicular to the at least one moving steel wire and/or ribbon to be treated, and, wherein bottom ends of the two plates are situated towards the bottom part of the vessel, the bottom ends of the two plates being separated by a second separation that is greater than the first narrow separation, wherein the supply means for supplying gas bubbles are arranged between the bottom ends of the two plates.

6. Device according to claim 1, wherein the spouting means for spouting the liquid curtain include multiple supply means for supplying the pressurized gas bubbles the device further comprising:

adjusting means for individually opening or closing, as required, the supply means for supplying the pressurized gas bubbles.

* * * * *